US009650809B2

(12) United States Patent
Unverdi et al.

(10) Patent No.: US 9,650,809 B2
(45) Date of Patent: May 16, 2017

(54) DISHWASHER COMPRISING A LOCKING MECHANISM

(71) Applicants: ARCELIK ANONIM SIRKETI, Istanbul (TR); Uygar Unverdi, Istanbul (TR); Erhan Ilhan Konukseven, Istanbul (TR)

(72) Inventors: Uygar Unverdi, Istanbul (TR); Erhan Ilhan Konukseven, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 194 days.

(21) Appl. No.: 14/370,042

(22) PCT Filed: Dec. 27, 2012

(86) PCT No.: PCT/EP2012/076955
§ 371 (c)(1),
(2) Date: Jun. 30, 2014

(87) PCT Pub. No.: WO2013/098327
PCT Pub. Date: Jul. 4, 2013

(65) Prior Publication Data

US 2015/0275552 A1 Oct. 1, 2015

(30) Foreign Application Priority Data

Dec. 30, 2011 (TR) ..... a 2011 13308

(51) Int. Cl.
*E05B 15/02* (2006.01)
*E05B 53/00* (2006.01)
(Continued)

(52) U.S. Cl.
CPC ..... *E05B 53/003* (2013.01); *A47L 15/0049* (2013.01); *A47L 15/4259* (2013.01);
(Continued)

(58) Field of Classification Search
CPC ..... A47L 15/4259; A47L 15/503; E05B 2015/0431; E05B 53/003; E05C 3/24;
(Continued)

(56) References Cited

U.S. PATENT DOCUMENTS 3,507,531 A 4/1970 Smith
7,896,972 B2 * 3/2011 Berends ..... A47L 15/0034 134/18

(Continued)

OTHER PUBLICATIONS

International search report and written opinion, dated Mar. 19, 2013, of corresponding International Application No. PCT/EP2012/076955; 6 pgs.

*Primary Examiner* — Mark Williams
(74) *Attorney, Agent, or Firm* — Kilpatrick Townsend & Stockton LLP

(57) ABSTRACT

The present invention relates to a dishwasher (1) wherein the stiffness level of the stress means (7) is provided to be kept at different values by means of the adjustment means (8) during the washing cycle, the locking mechanism (4) is provided to remain locked completely by adjusting the stiffness level of the stress means (7) by means of the adjustment means (8) depending on the requirement at the respective stage of the washing cycle, the stiffness level is adjusted to the lowest value before or after the washing process for easily opening the door (3) and the locking mechanism (4) is provided not to open easily in order to prevent escape of steam from inside the body (2) during the washing process by adjusting the stiffness level of the stress means (7) by means of the adjustment means (8).

20 Claims, 1 Drawing Sheet

Figure 1:
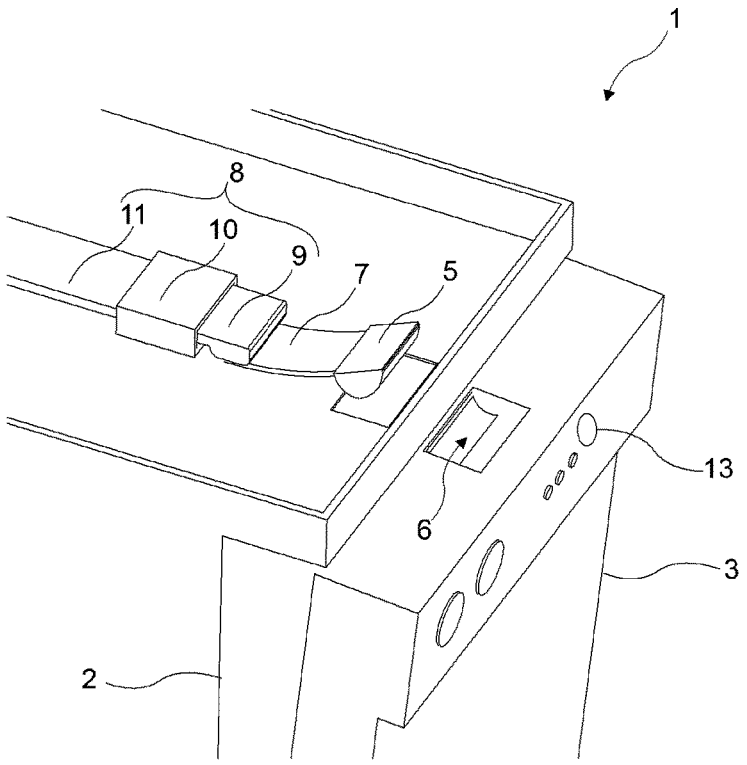

(51) Int. Cl.

| | |
|---|---|
| ***A47L 15/00*** | (2006.01) |
| ***A47L 15/42*** | (2006.01) |
| ***E05C 19/06*** | (2006.01) |
| *E05B 47/00* | (2006.01) |
| *E05B 15/04* | (2006.01) |

(52) U.S. Cl.
CPC ..... *E05C 19/063* (2013.01); *A47L 2301/08* (2013.01); *A47L 2401/34* (2013.01); *A47L 2501/22* (2013.01); *E05B 47/0009* (2013.01); *E05B 47/0012* (2013.01); *E05B 2015/0431* (2013.01); *Y10T 292/705* (2015.04)

(58) Field of Classification Search
CPC ..... E05C 5/00; Y10T 292/0899; Y10T 292/1028; Y10T 292/0841; Y10T 292/432; Y10S 292/69; E05Y 2900/304
USPC ..... 292/38, 341.18, 10, 125, 106, 107, 303
See application file for complete search history.

(56) References Cited

U.S. PATENT DOCUMENTS

| | | | | |
|---|---|---|---|---|
| 8,651,535 | B2 * | 2/2014 | Oppel | 292/100 |
| 8,882,933 | B2 * | 11/2014 | Assmann | A47L 15/4259 134/57 DL |
| 2005/0285412 | A1 | 12/2005 | Kim | |
| 2010/0236589 | A1 * | 9/2010 | House | A47L 15/4259 134/58 DL |

* cited by examiner

DISHWASHER COMPRISING A LOCKING MECHANISM

The present invention relates to a dishwasher comprising a locking mechanism.

In dishwashers, the door of the dishwasher has to be kept locked so that it is not opened as the result of the created pressure and the hot environment formed inside the washing tub during the washing and drying processes. In order to provide the safety conditions, the door lock is designed with the stiffness to withstand the said pressure. However, the door lock being stiff creates difficulty of utilization in terms of the user during opening and closing of the door and results in dissatisfaction.

On the other hand, the door lock of the dishwasher has to be in openable position to allow for loading of items into the dishwasher during washing. However, the door lock being in openable position during the washing process is not compatible with the childproof-lock application that provides the door lock not to be opened uncontrollably by the children as requested by some users and realizing both applications separately or together causes the door lock mechanisms to become complicated.

In the state of the art United States of America Patent Application No. US2005-0285412, a dishwasher is explained wherein the decrease in the elastic modulus of the lock spring depending on utilization is solved by making the spring elastic modulus adjustment by the user.

The aim of the present invention is the realization of a dishwasher comprising a locking mechanism that provides ease of utilization in all stages of the utilization cycle.

In the dishwasher realized in order to attain the aim of the present invention, explicated in the first claim and the respective claims thereof, the stiffness level of the stress means, whereto the bolt is connected, is changed by means of an adjustment means during, prior to and afterwards the washing and drying processes.

In the dishwasher, the process that starts with loading the items to be washed into the dishwasher before the washing process is started, that includes the washing process and that is completed with the unloading of the washed items from the dishwasher after the washing process is named as the washing cycle. During a single washing cycle, the stress means is kept at different stiffness levels by means of the adjustment means. In stages wherein the items to be washed are loaded into or unloaded from the dishwasher, the force exerted by the adjustment means to the stress means is decreased so that the door can be opened easily. During the washing process or when the childproof-lock is desired to be activated, the force exerted by the adjustment means to the stress means is increased.

In an embodiment of the present invention, the stiffness level of the stress means is decreased in stages of the washing cycle prior to the starting of the washing process or after the washing process is completed in order to provide the door to be opened easily by the user. In this embodiment, the force exerted by the adjustment means on the stress means is decreased.

In a derivative of this embodiment, in the washing stage of the washing cycle, the stiffness level of the stress means is at a higher level than the steps prior to the starting of the washing process and after the washing process is completed. In this embodiment, the force exerted by the adjustment means on the stress means is increased. Thus, the door is prevented from opening unintentionally with the pressure of the hot air and steam mixture inside the body during the washing process.

In a derivative of this embodiment, in the stage wherein the rinsing step of the washing process is completed, the stiffness level of the stress means is at the lowest level in order to facilitate leaving the door ajar after the rinsing step for increasing the rinsing performance. In this embodiment, the force exerted on the stress means by the adjustment means is at the lowest level.

In a derivative of this embodiment, the stiffness level of the stress means is at the highest level in childproof-lock application wherein the door is not desired to be opened unintentionally. In this embodiment, the force exerted on the stress means by the adjustment means is at the highest level.

In another embodiment of the present invention, the adjustment means comprises a rod that is moved inside a bearing by being actuated by an actuator and which exerts force on the stress means. The rod and the stress means are positioned to be one over the other. As the position of the rod is changed, the support point of the stress means and hence the stiffness level are changed.

In a derivative of this embodiment, the adjustment means comprises a transmitter that provides the connection between the actuator and the rod.

In another embodiment of the present invention, the adjustment means is activated mechanically by the user.

In another embodiment of the present invention, the stiffness level of the stress means is changed by the adjustment means by detecting the user getting close to the dishwasher or the hand of the user getting close to the door by means of a sensor.

In another embodiment of the present invention, the stiffness level of the stress means is changed more than once by means of the adjustment means during one washing cycle. Consequently, a low level stiffness is maintained in the stress means before the washing process, during the washing process a stiffness level that is higher than that of before the washing process and again a low level stiffness at the end of the washing process is maintained.

In the dishwasher of the present invention, the stiffness level of the stress means and hence the stiffness level of the bolt connected to the stress means are changed by means of the adjustment means.

The dishwasher realized in order to attain the aim of the present invention is illustrated in the attached figures, where:

FIG. 1—is the schematic isometric view of a dishwasher.

Figure 2:
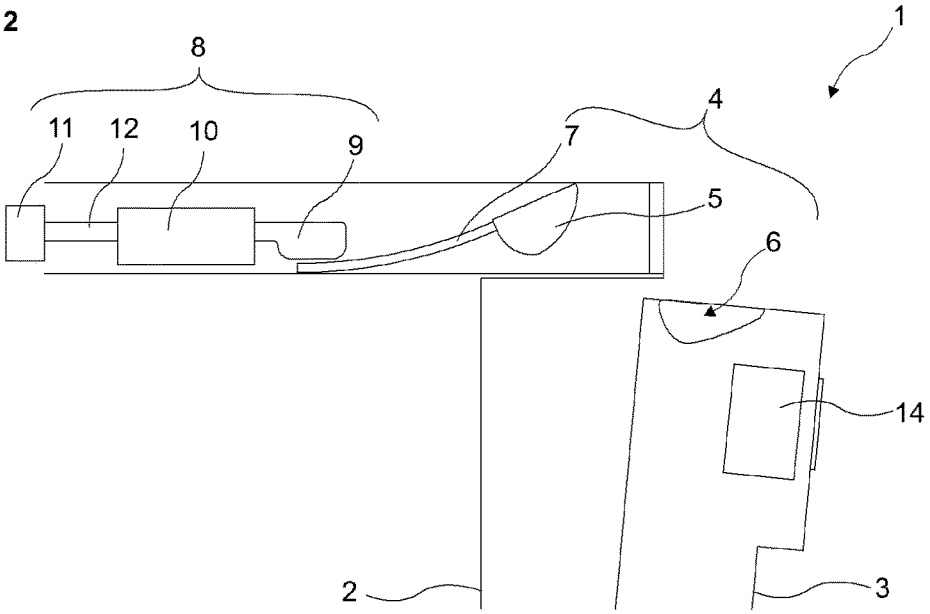

FIG. 2—is the sideways schematic view of a dishwasher.

The elements illustrated in the figures are numbered as follows:

1. Dishwasher
2. Body
3. Door
4. Locking mechanism
5. Bolt
6. Housing
7. Stress means
8. Adjustment means
9. Rod
10. Bearing
11. Actuator
12. Transmitter
13. Sensor
14. Control unit The dishwasher (1) comprises a body (2), a door (3) providing access into the body (2) and which opens from the top downwards by rotating around the horizontal axis and a locking mechanism (4) that provides the door (3) to be locked.

The locking mechanism (4) comprises a bolt (5), a housing (6) wherein the bolt (5) is seated when the door (3) is in the closed position and a stress means (7) that is connected to the bolt (5).

In the dishwasher (1), the process that starts with loading the items to be washed into the dishwasher (1) before the washing process is started, that includes the washing process and that is completed with the unloading of the washed items from the dishwasher (1) after the washing process is named as a washing cycle.

The dishwasher (1) comprises an adjustment means (8) that provides the stress means (7) to be kept at different stiffness levels by changing the stiffness level during a single washing cycle. By means of the adjustment means (8), the stiffness level of the stress means (7) is decreased in stages wherein the locking mechanism (4) is desired to be opened easily during the washing cycle. Accordingly, the door (3) is provided to be opened easily. In stages wherein the locking mechanism (4) is not desired to be opened or to be opened with difficulty, the stiffness level of the stress means (7) is increased by the adjustment means (8). Consequently, the door (3) is provided to be opened with difficulty or not to be opened.

In an embodiment of the present invention, in the dishwasher (1), in the stage of the washing cycle before the washing process is started, the stress means (7) is kept at a first stiffness level (k1) by means of the adjustment means (8). In the first stiffness level (k1), an amount of stress is exerted on the bolt (5) by the stress means (7) at a level wherein the locking mechanism (4) can function actively when the door (3) is closed. The bolt (5) is subject to an amount of stress that does not allow it to be dislodged from the housing (6) when the door (3) is closed. However, the user exerts a low level force for dislodging the bolt (5) from the housing (6) or for seating the bolt (5) in the housing (6). In the washing stage of the washing cycle, the stress means (7) is kept at a second stiffness level (k2) by means of the adjustment means (8). The second stiffness level (k2) is a value that is higher than the first stiffness level (k1). Thus, the pressure exerted on the bolt (5) by the stress means (7) increases during the washing process, and the dislodging of the bolt (5) from the housing (6) and opening/closing of the door (3) become difficult. Opening/closing of the door (3) is made difficult during the washing process in order to withstand the pressure exerted by the heat and steam forming inside the body (2).

In a derivative of this embodiment, in the dishwasher (1), in the stage of the washing cycle after the washing process is completed, the stress means (7) is kept at a third stiffness level (k3) by means of the adjustment means (8). The third stiffness level (k3) is a value that is lower than the second stiffness level (k2). Thus, the pressure exerted on the bolt (5) by the stress means (7) decreases at the end of the washing process, and the dislodging of the bolt (5) from the housing (6) and opening/closing of the door (3) are facilitated. Consequently, the user exerts a low level force for dislodging the bolt (5) from the housing (6) or for seating the bolt (5) in the housing (6).

In a derivative of this embodiment, in the dishwasher (1), in the stage of the washing cycle after the rinsing step is completed at the end of the washing process, the stress means (7) is kept at a fourth stiffness level (k4) by means of the adjustment means (8). The fourth stiffness level (k4) is the lowest stiffness level of the stress means (7). In this stage, the door (3) is opened ajar in order to discharge the steam inside the body (2) to the outside by a door opening mechanism (not shown in the figures). Thus, the effectiveness of the rinsing step is increased by discharging the steam inside the body (2). Consequently, the door opening mechanism exerts a low level force for dislodging the bolt (5) from the housing (6).

In a derivative of this embodiment, the stress means (7) is kept at a fifth stiffness level (k5) by means of the adjustment means (8). The fifth stiffness level (k5) is the highest stiffness level whereat the stress means (7) is kept. In the fifth stiffness level (k5), an amount of stress is exerted on the bolt (5) by the stress means (7) at a level whereat the locking mechanism (4) cannot be opened without damage when the door (3) is closed. The bolt (5) is subject to an amount of stress that does not allow it to be dislodged from the housing (6) when the door (3) is tried to be opened while closed. In this stage, uncontrollable access of particularly the children into the body (2) is prevented. When the door (3) is desired to be opened, the stiffness level of the stress means (7) is decreased by means of the adjustment means (8).

In another embodiment of the present invention, the stress means (7) is configured as a plate.

In a derivative of this embodiment, the adjustment means (8) comprises a rod (9) that exerts force on the stress means (7), a bearing (10) positioned so that the rod (9) moves therein and an actuator (11) that changes the position of the rod (9). The stress means (7) and the rod (9) are aligned with each other in the same direction such that the stress means (7) remains at least partially below the rod (9). The point whereon pressure is exerted on the stress means (7) with the linear movement of the rod (9) that is moved by the actuator (11), changes and respectively the stiffness level of the stress means (7) changes.

In a derivative of this embodiment, the adjustment means (8) comprises a transmitter (12) that provides transmission of movement between the actuator (11) and the rod (9). The actuator (11) can be an electric motor or a thermal pusher.

In another embodiment of the present invention, the adjustment means (8) is a mechanical system that can be adjusted manually by the user.

In another embodiment of the present invention, the dishwasher (1) comprises a sensor (13) that detects the user or the user's hand in its proximity and a control unit (14) that changes the stiffness level of the stress means (7) by actuating the adjustment means (8) depending on the data received from the sensor (13).

In another embodiment of the present invention, the bolt (5) is disposed on the body (2) and the housing (6) on the door (3).

In another embodiment of the present invention, in the dishwasher (1), the stiffness level of the stress means (7) is changed more than once by means of the adjustment means (8) during the washing cycle.

In the dishwasher (1) of the present invention, the stiffness level of the stress means (7) is provided to be kept at different values by means of the adjustment means (8) during the washing cycle. Depending on the requirement at the respective stage of the washing cycle, when the child-proof-lock is activated, the locking mechanism (4) is provided to remain completely locked by adjusting the stiffness level of the stress means (7) by means of the adjustment means (8), the stiffness level is adjusted to the lowest value before or after the washing process for easily opening the door (3), the locking mechanism (4) is provided not to open easily in order to prevent steam escape from inside the body (2) during the washing process by adjusting the stiffness level of the stress means (7) by means of the adjustment means (8).

It is to be understood that the present invention is not limited by the embodiments disclosed above and a person skilled in the art can easily introduce different embodiments. These should be considered within the scope of the protection postulated by the claims of the present invention.

The invention claimed is:

1. A dishwasher (1) comprising a body (2), a door (3) providing access into the body (2) and which opens from the top downwards by rotating around a horizontal axis, and a locking mechanism (4), that provides the door (3) to be locked, the locking mechanism having a bolt (5), a housing (6) wherein the bolt (5) is seated when the door (3) is in the closed position and a stress means (7) that is connected to the bolt (5), an adjustment means exerting force on the stress means (8) to keep the stress means (7) at different stiffness levels by varying an amount of the force exerted on the stress means during a washing cycle.

2. A dishwasher (1) as in claim 1, characterized by the adjustment means (8) that provides the stiffness level of the stress means (7) to be decreased in stages wherein the locking mechanism (4) is desired to be opened easily during the washing cycle, and provides the stiffness level of the stress means (7) to be increased in stages wherein the locking mechanism (4) is desired not to be opened or to be opened with difficulty.

3. A dishwasher (1) as in claim 1, characterized by the adjustment means (8) which is a mechanical system that can be adjusted manually by the user.

4. A dishwasher (1) as in claim 1, characterized by a sensor (13) that detects the user or the user's hand in its proximity and a control unit (14) that changes the stiffness level of the stress means (7) by actuating the adjustment means (8) depending on the data received from the sensor (13).

5. A dishwasher (1) as in claim 1, characterized by the bolt (5) disposed on the body (2) and the housing (6) disposed on the door (3).

6. A dishwasher (1) as in claim 1, characterized by the stress means (7), the stiffness level of which is changed more than once by means of the adjustment means (8) during the washing cycle.

7. A dishwasher (1) as in claim 1, characterized by the adjustment means (8) that keeps the stress means (7) at a first stiffness level (k1) in the stage of the washing cycle before the washing process is started and at a second stiffness level (k2), a higher value than the first stiffness level (k1), in the washing stage of the washing cycle.

8. A dishwasher (1) as in claim 7, characterized by the adjustment means (8) that keeps the stress means (7) at a third stiffness level (k3) that is at a lower value than the second stiffness level (k2) in the stage of the washing cycle after the washing process is completed.

9. A dishwasher (1) as in claim 8, characterized by the adjustment means (8) that keeps the stress means (7) at a fourth stiffness level (k4), that is the lowest stiffness level of the stress means (7), at the end of the washing process, in the stage after the rinsing step is completed.

10. A dishwasher (1) as in claim 1, characterized by the adjustment means (8) that keeps the stress means (7) at a fifth stiffness level (k5), that is the highest stiffness level the stress means (7) is kept, such that the locking mechanism (4) cannot be opened without damage when the door (3) is closed.

11. A dishwasher (1) as in claim 1, characterized by the adjustment means (8) having the plate-shaped stress means (7) and a rod (9) that exerts force on the stress means (7), a bearing (10) positioned so that the rod (9) moves therein and an actuator (11) that changes the position of the rod (9).

12. A dishwasher (1) as in claim 11, characterized by the stress means (7) and the rod (9) that are aligned with each other in the same direction such that the stress means (7) remains at least partially below the rod (9).

13. A dishwasher (1) comprising a body (2), a door (3) providing access into the body (2) and which opens from the top downwards by rotating around a horizontal axis, and a locking mechanism (4), that provides the door (3) to be locked, having a bolt (5), a housing (6) wherein the bolt (5) is seated when the door (3) is in the closed position and a stress means (7) that is connected to the bolt (5), an adjustment means (8) to keep the stress means (7) at different stiffness levels during a washing cycle and characterized by the adjustment means (8) that provides the stiffness level of the stress means (7) to be decreased in stages wherein the locking mechanism (4) is desired to be opened easily during the washing cycle, and provides the stiffness level of the stress means (7) to be increased in stages wherein the locking mechanism (4) is desired not to be opened or to be opened with difficulty and characterized by the adjustment means (8) that keeps the stress means (7) at a first stiffness level (k1) in the stage of the washing cycle before the washing process is started and at a second stiffness level (k2), a higher value than the first stiffness level (k1), in the washing stage of the washing cycle.

14. A dishwasher (1) as in claim 13, characterized by the adjustment means (8) that keeps the stress means (7) at a third stiffness level (k3) that is at a lower value than the second stiffness level (k2) in the stage of the washing cycle after the washing process is completed.

15. A dishwasher (1) as in claim 14, characterized by the adjustment means (8) that keeps the stress means (7) at a fourth stiffness level (k4), that is the lowest stiffness level of the stress means (7), at the end of the washing process, in the stage after the rinsing step is completed.

16. A dishwasher (1) as in claim 15, characterized by the adjustment means (8) that keeps the stress means (7) at a fifth stiffness level (k5), that is the highest stiffness level the stress means (7) is kept, such that the locking mechanism (4) cannot be opened without damage when the door (3) is closed.

17. A dishwasher (1) as in claim 16, characterized by the adjustment means (8) having the plate-shaped stress means (7) and a rod (9) that exerts force on the stress means (7), a bearing (10) positioned so that the rod (9) moves therein and an actuator (11) that changes the position of the rod (9).

18. A dishwasher (1) as in claim 17, characterized by the stress means (7) and the rod (9) that are aligned with each other in the same direction such that the stress means (7) remains at least partially below the rod (9).

19. A dishwasher (1) as in claim 18, characterized by the adjustment means (8) comprising a transmitter (12) that provides transmission of movement between the actuator (11) and the rod (9).

20. A dishwasher (1) comprising a body (2), a door (3) providing access into the body (2) and which opens from the top downwards by rotating around a horizontal axis, and a locking mechanism (4), that provides the door (3) to be locked, having a bolt (5), a housing (6) wherein the bolt (5) is seated when the door (3) is in the closed position and a stress means (7) that is connected to the bolt (5), an adjustment means (8) to keep the stress means (7) at different stiffness levels during a washing cycle and characterized by the adjustment means (8) having the plate-shaped stress means (7) and a rod (9) that exerts force on the stress means (7), a bearing (10) positioned so that the rod (9) moves therein and an actuator (11) that changes the position of the rod (9) and characterized by the stress means (7) and the rod (9) that are aligned with each other in the same direction such that the stress means (7) remains at least partially below the rod (9) and characterized by the adjustment means (8) comprising a transmitter (12) that provides transmission of movement between the actuator (11) and the rod (9).

* * * * *